United States Patent [19]

Folk

[11] 3,956,822

[45] May 18, 1976

[54] METHOD AND APPARATUS FOR POSITIONING INDIVIDUAL LEADS UTILIZING AN IMPROVED TEMPLATE

[75] Inventor: Kenneth Foster Folk, Harrisburg, Pa.

[73] Assignee: AMP Incorporated, Harrisburg, Pa.

[22] Filed: Oct. 15, 1974

[21] Appl. No.: 514,349

[52] U.S. Cl. ..... 29/628; 29/203 DT; 29/203 P; 29/630 A

[51] Int. Cl.[2] ..... H01R 43/00

[58] Field of Search ..... 29/628, 629, 630 R, 29/630 A, 203 D, 203 DS, 203 P, 203 S, 203 I, 203 DT; 140/105

[56] References Cited

UNITED STATES PATENTS

| | | | |
|---|---|---|---|
| 3,636,991 | 1/1973 | Webster | 29/630 R |
| 3,708,853 | 1/1973 | Humen et al. | 29/203 D |
| 3,765,073 | 10/1973 | Burns | 29/203 D |

OTHER PUBLICATIONS

Western Electric Technical Digest No. 34, Apr. 1974, pp. 23–24.

*Primary Examiner*—C. W. Lanham
*Assistant Examiner*—James R. Duzan
*Attorney, Agent, or Firm*—Gerald K. Kita

[57] ABSTRACT

A method and apparatus for positioning lengths of individual leads of a plurality of leads in spaced apart relationships with respect to each other so that work operations can be simultaneously performed upon the ends of the leads, the lengths of the leads being positioned in a plurality of spaced apart grooves on a template by progressively positioning successive parts of the lengths of each of said plurality of leads into said grooves, the grooves being of improved construction so that the lengths of the leads are not unduly elongated as they are positioned within the grooves. Each of the grooves has one or more principle portions and spaced apart lead confining means, the principle portions having spaced apart sidewalls of a width greater than the maximum width of a lead which is to be associated with said groove, and the spaced apart lead retaining means having spaced apart sidewalls which are spaced apart from each other a distance less than the minimum width of the leads, the spaced apart lead retaining means retaining spaced apart segments of the lengths positioned in the grooves. Knock-out pins are associated with each of the spaced apart lead retaining means to facilitate stripping the leads from the template.

17 Claims, 9 Drawing Figures

METHOD AND APPARATUS FOR POSITIONING INDIVIDUAL LEADS UTILIZING AN IMPROVED TEMPLATE

CROSS REFERENCE TO RELATED APPLICATIONS

This applications relates to U.S. application Ser. No. 389,924 filed Aug. 27, 1973 and entitled "Method And Apparatus For Positioning Leading Portions Of Individual Wires Of A Plurality Of Wires In Spaced Relationships With Respect To Each Other And A Template Utilized In Accomplishing The Same", and also to U.S. application Ser. No. 424,129 filed Dec. 12, 1973 and entitled "Method And Apparatus For Varying Relative Length Of A Plurality Of Leads And For Performing Work Operations On The Ends Of Leads Of Differing Relative Lengths", both of these related applications being assigned to same assignee as this application, the second of these related applications being a continuation-in-part of the first application.

FIELD OF THE INVENTION

The present invention relates generally to a method and apparatus for positioning lengths of a plurality of leads in spaced apart relationships with respect to each other so that work operations can be performed upon the ends of the leads, the plurality of leads being progressively positioned in spaced apart grooves on a template, and more particularly, to an improved groove construction which minimizes the likelihood of the leads being elongated or extruded as they are progressively positioned within the grooves on the template.

BACKGROUND OF THE INVENTION

In U.S. applications Ser. Nos. 389,924 and 424,129 method and apparatus are disclosed which position a plurality of associated leads in spaced apart relationships with respect to each other, this positioning being done by an apparatus which includes a template having a plurality of spaced apart grooves, each of the spaced apart grooves being capable of receiving only a single lead. The leads are placed in the grooves on the template by holding a portion of the leads adjacent one end of the grooves and progressively positioning lengths of the leads into the grooves by applying a compressive force along the upper surface of the lengths of the leads to progressively force the lengths into the grooves as the compressive force is moved from one end of the grooves to the other. In the prior art the grooves have been dimensioned relative to the leads in such a manner that the grooves will retain the leads. Thus, in the prior art constructions, the grooves have a width slightly less than the width of the leads which are to be associated with the grooves, and the leads are held between the spaced apart walls of the grooves by frictional contact. However, it has been found that when employing this construction wherein there is an interference fit between the grooves and the entire length of the leads that certain types of leads or long length leads may be unduly elongated during the application of the compressive force from one end of the grooves to the other. For example, when leads of predetermined lengths are to be positioned relative to each other so that work operations may be performed on the cut and stripped ends of the leads, any undue elongation of the leads is undesirable since the leads may be stretched to such an extent that the bared ends of the pre-cut leads may extend beyond the work zone where the subsequent operations are to be performed. In another example where it is desirable to have the completed leads of precise length the prior art design is undesirable as the amount of elongation of the leads will vary from lot to lot depending principally upon variations of the type of material employed in the leads and also the thickness of the leads. Thus, the thickness of one type of leads may vary from a diameter of from approximately one millimeter to one and one quarter millimeters. Therefore, in order to assure precision length of leads and also to insure that work operations be performed upon stripped ends of leads which have been previously cut to desired lengths it is essential that elongation of the leads by minimized.

OBJECTS AND SUMMARY OF THE INVENTION

It is a principle object of the present invention to provide a method and apparatus whereby a plurality of leads can be progressively positioned into a plurality of spaced apart grooves on a template in such a manner that the leads will not be unduly stretched or elongated.

More particularly, it is an object of the present invention to provide a novel groove construction for a template having a plurality of spaced apart grooves in which a plurality of leads are progressively positioned, each of said grooves having one or more principle portions of a width and depth in excess of the maximum width of the lead which is to be associated with said groove so that the lead will not be stretched as it is progressively forced into the principle portions of the groove, the grooves also having spaced apart lead retaining means which serve to maintain the lead within the grooves.

It is also an object of the present invention to provide a manner by which leads can be advantageously stripped from a template having spaced apart grooves, each of the grooves having one or more enlarged principle portions and spaced apart lead retaining means.

These and other objects and advantages of the present invention are accomplished by providing a template having a plurality of grooves, each of said grooves being capable of receiving only a single lead, and each of said grooves having one or more elongated principle portions and spaced apart lead retaining means defined by spaced apart sidewalls, the sidewalls in said principle portions being spaced apart from each other a width in excess of the maximum width of the leads, and the sidewalls in the spaced apart lead retaining means being normally spaced apart from each other a distance less than the minimum width of said leads. One of the sidewalls in the spaced apart lead retaining means is movable towards and away from the other of said sidewalls, said one sidewall being an end wall of a shiftable member which is normally biased in a direction perpendicular to the other sidewall, the shiftable member being mounted for movement between two spaced apart stop positions. In addition, knockout pins are associated with each of the spaced apart lead retaining means to push the leads from the lead retaining means when it is desired to strip the leads from the template.

These and other objects and features will be apparent to those skilled in the art after a consideration of the following detailed description taken in conjunction with the accompanying drawings in which a preferred form of this invention is shown.

DETAILED DESCRIPTION OF A PREFERRED EMBODIMENT

Figure 1:
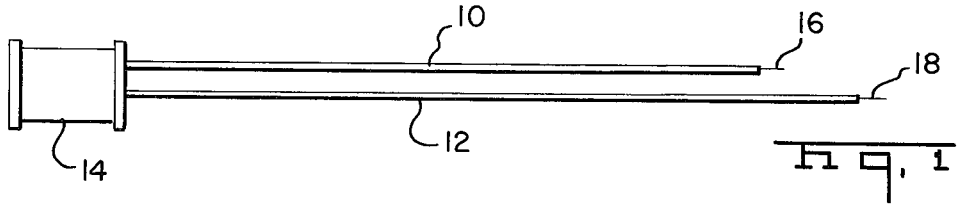
FIG. 1 shows a lead assembly including an electrical sub-assembly having secured thereto a plurality of leads which may be advantageously positioned by the method and apparatus of this invention.
Figure 2:
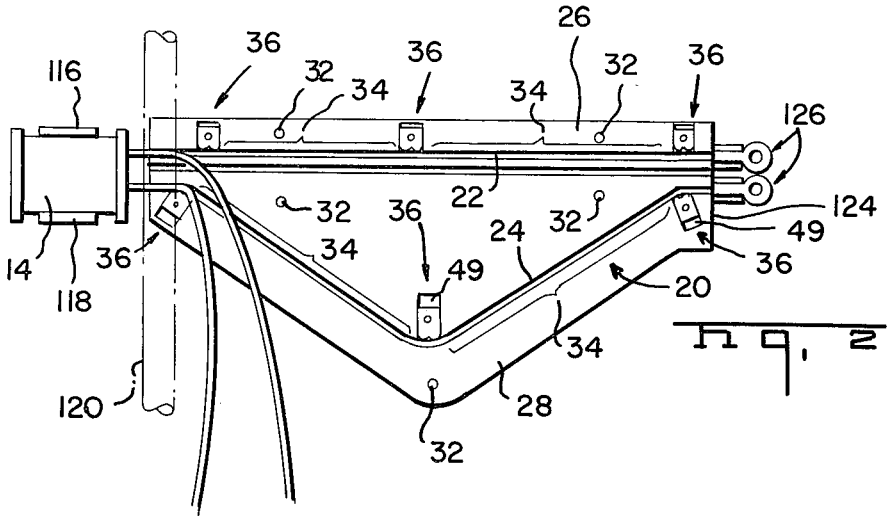
FIG. 2 shows the lead assembly of FIG. 1 initially associated with template means having two spaced apart grooves.
Figure 3:
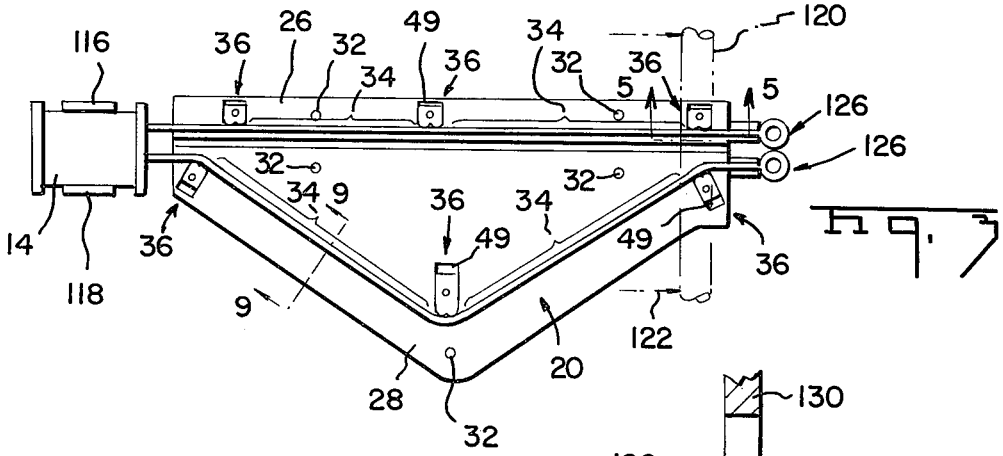
FIG. 3 shows the lead assembly of FIG. 1 after its leads have been disposed in the grooves on the template means.

The method and apparatus of this invention may be utilized when working upon a lead assembly including a plurality of leads which extend outwardly from an electrical sub-assembly. The lead assembly shown in FIG. 1 includes a pair of leads 10, 12, the pair of leads extending outwardly from an electrical sub-assembly 14 to which one end of each of the leads is secured. The electrical subassembly 14 shown in the drawing represents a coil assembly to which the leads 10 and 12 have been previously secured, the leads 10 and 12 being of a predetermined length and having cut and stripped ends 16, 18 to which terminals or the like are to be secured. The leads will be associated with template means, indicated generally at 20, to properly orient the ends of the leads 16, 18 with respect to each other for the performance of subsequent work operations upon the ends of the leads.

Figure 4:
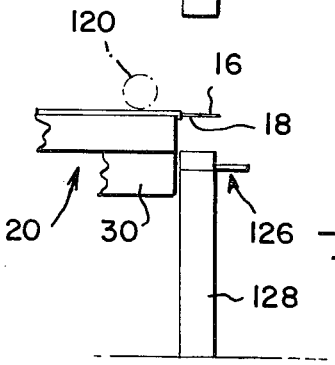
FIG. 4 is a fragmentary side elevation of the apparatus shown in FIGS. 2 and 3 showing how additional operations may be performed upon the ends of the leads.

While only a single embodiment is shown in the drawings accompanying this specification, it should be appreciated that if differing forms of lead assemblies were worked upon then it would be necessary to modify the structure of the template means somewhat to accommodate the differing types of lead assemblies. Thus, for example, if terminals were to be applied to leads which emanate from a multi-lead cable of the type shown in FIG. 1A of U.S. application Ser. No. 424,129 then it may be desirable to employ a template construction of the type shown in U.S. application Ser. No. 389,924, a template construction of the type shown in FIG. 1 of U.S. application Ser. No. 424,129 or even a template construction of the type shown in U.S. application Ser. No. 424,133. Similarly, if the leads which are to be worked upon by the method and apparatus of this invention extend outwardly from a plurality of individual supply spools, then template means of the type shown in FIG. 4 of U.S. application Ser. No. 424,129 may be employed. Other specific variations of template designs within which the principles of the present invention may be employed would have to be constructed in accordance with the particular requirement of the lead assembly which is to be worked upon, bearing in mind the requirements of the differing lengths of the leads, if any, and also the nature of the work which is to be performed upon the ends of the leads.

Figure 6:
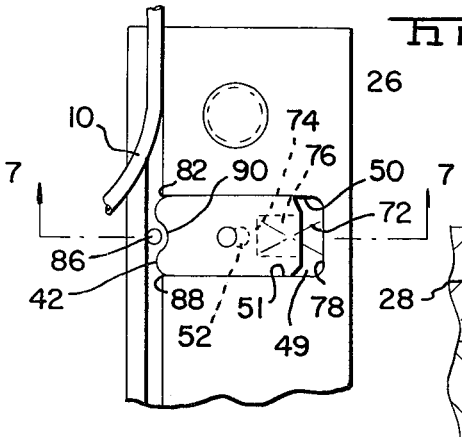
FIG. 6 is an enlarged fragmentary view of the structure shown in FIG. 2.
Figure 7:
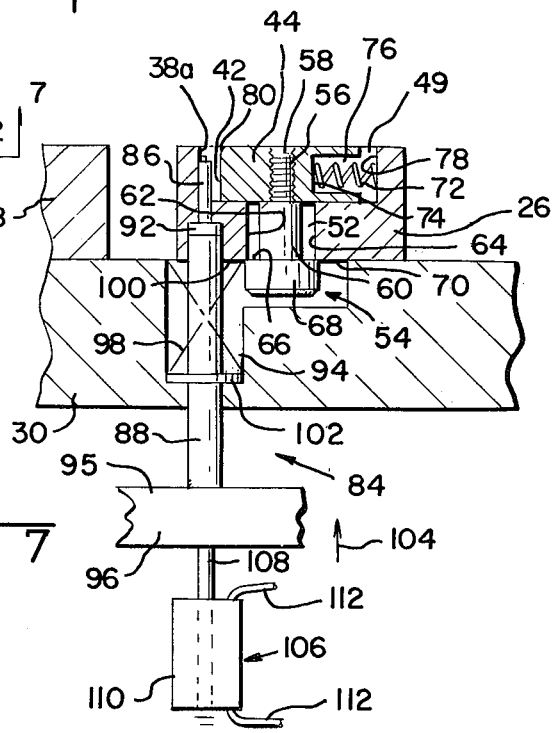
FIG. 7 is a view taken generally along the lines 7—7 in FIG. 6 showing one of the spaced apart lead retaining means and its associated knock-out pin means.
Figure 8:
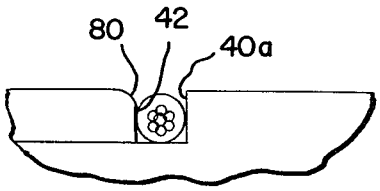
FIG. 8 is a fragmentary sectional view taken through one of the spaced apart lead retaining means showing how a lead is held within one of the spaced apart lead retaining means of one of the grooves.
Figure 9:
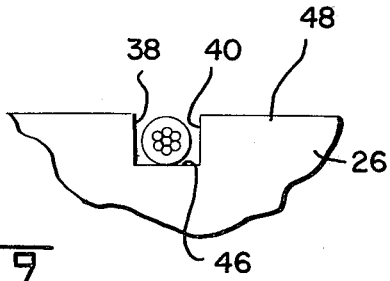
FIG. 9 is a section taken generally along the lines 9—9 in FIG. 3 showing a lead disposed within a principle portion of one of the grooves of the template.

Referring now to FIGS. 2 through 9, the template means 20 includes surface means provided with a plurality of spaced apart grooves 22, 24. The surface means includes two spaced apart members 26, 28 which are rigidly interconnected to a single supporting member 30 (FIG. 7) by a plurality of fasteners 32, the heads of the fasteners being flush with the upper surface of the spaced apart members 26, 28. Each of the grooves 22, 24 has elongated principal portions and spaced apart lead retaining means, the principal portions being indicated by the brackets 34 and the spaced apart lead retaining means being indicated generally at 36. Each of the grooves 22, 24 are defined by spaced apart sidewalls and a bottom wall, the spaced apart sidewalls of the principal portions being indicated at 38 and 40 (FIG. 9), and the spaced apart sidewalls of the lead retaining means being indicated by 42 and either **38*a* (FIG. 7) or 40*a* (FIG. 8). The one sidewall 42 within the lead retaining means is an end wall of a shiftable member 44, and the other sidewall 38*a* or 40*a* of the lead retaining means is in fact an extension of one of the sidewalls 38 or 40** of a principal portion.

Each of the grooves 22, 24 is capable of receiving only a single lead. However, in order to prevent the leads from being stretched the sidewalls 38, 40 of each of the principal portions are spaced apart from each other a width in excess of the maximum width of a lead which is to be associated with the groove. Thus, as the leads 10 and 12 may have a diameter anywhere between one, and one and one-quarter millimeters, the sidewalls 38, 40 are spaced apart from each other an amount slightly in excess of one and one-quarter millimeters, that is the maximum diameter of the leads which are to be associated with that particular groove. It should also be noted at this point that the bottom wall 46 is also spaced below the upper surface 48 of the surface means a distance which is also slightly in excess of the maximum width of the lead which is to be associated with the particular groove.

As there is no interference fit between the leads and the principal portions 34 of the grooves in the template means, the leads would be free to move out of the grooves. Therefore, the spaced apart lead retaining means are so designed that spaced apart portions of the leads disposed within the grooves of the template means will be held therein. Thus, the sidewalls in the spaced apart lead retaining means are spaced apart from each other a width less than the minimum width of the leads which are to be associated with the particular spaced apart lead retaining means.

The grooves 22, 24 are formed in the spaced apart members 26, 28 by milling the upper surface in such a manner that the grooves are formed therein. Spaced apart recesses 49 are also milled in the upper surface of the spaced apart members 26, 28, the spaced apart recesses 49 having parallel spaced apart sidewalls 50, 51 generally perpendicular to one of the sidewall extensions 38*a*, 40*a*. Each of the shiftable members 44 is disposed within one of the spaced apart recesses 49 for sliding movement in a direction perpendicular to the other sidewall 38*a*, 40*a* of the associated grooves 38 and 40, respectively. Means are provided to limit the sliding movement of the shiftable members between two spaced apart stop positions, and to this end elongated apertures 52 are formed in the spaced apart members 20, 28 in association with each of the spaced apart grooves, the apertures 52 extending entirely through the spaced apart members 26, 28. A shouldered cap screw, indicated generally at 54, is provided for each of the shiftable members 44, the cap screw having its threaded end 56 received within a threaded aperture 58 of the associated shiftable member 44, the shouldered portion 60 of the shouldered cap screw 54 being adapted to contact spaced apart sides 62, 64 of the elongated aperture as a shiftable member is moved between its two stop positions. Cut-out portions are provided in the member 30 below each of the apertures 52 to receive the head of the cap screw. The upper surface 66 of the enlarged head 68 of the cap screw rides along the lower surface 70 of the associated spaced apart member as the shiftable member is shifted between its two stop positions. Means are provided to bias the sidewall 42 of the shiftable member 44 towards the other sidewall 38*a*, 40*a* in such a manner that a lead disposed between the sidewall 42 and the associated sidewall 38*a*, 40*a* will be held from movement out of the groove without undue damage to the lead, one side of the lead being biased into engagement with the sidewall 38*a*, 40*a* of the associated groove. To this end, compression spring means 72 are provided, one end of the compression spring means 72 bearing against the bottom 74 of an aperture 76 formed within the shiftable member 44, and the other end of the compression spring means bearing against an end wall 78 of the associated recess 50, the end wall 78 being spaced away from the sidewall 38*a* or 40*a*. The rate of the spring means is such that the lead will be properly held within the groove without damage to the lead, even though the range of diameters of the lead may vary by as much as twenty-five percent.

In order to prevent damage to the leads as they are being laid in the spaced apart lead retaining means, each of the shiftable members has its end walll 42 provided with an upper rounded corner 80 (FIG. 8) and also laterally spaced apart rounded corners 82 which can best be seen in FIG. 6.

As the leads are firmly held within the spaced apart lead retaining means, it is somewhat difficult to strip the leads when desired from the template means. Therefore, pushing means have been provided which are operable to push the leads out of the spaced apart lead retaining means, the pushing means including push pin means, indicated generally at 84, there being one push pin means for each of the lead retaining means. Each of the push pin means 84 includes a generally cylindrical pin 86 which extends upwardly from a rod 88. Each of the cylindrical pins 86 is received within an aperture in one of the spaced apart members 26 or 28 and is adapted to cooperate with an associated shiftable member 44. To this end, it should be noted that the end wall 42 of the member 44 is provided with a notched portion 90 through which the pin 86 may extend if the shiftable member is disposed in its stop position most closely adjacent the other sidewall 38*a*, 40*a*. The members 26 and 28 are provided with enlarged apertures 92, each of the enlarged apertures 92 being concentric with and disposed below the aperture which receives one of the cylindrical pins 86. The upper end of each of the rods 88 is disposed within one of the apertures 92. The supporting member 30 is also provided with elongated apertures which extend from its upper surface to its lower surface, each of the elongated apertures having an enlarged upper portion 94 disposed adjacent the cut-out which receives the head 68 of the cap screw 54. The rods 88 extend through the elongated apertures and the lower end of all the rods 88 rest upon the upper surface 95 of a vertically shiftable member 96. A compression spring 98 is disposed about each of the rods 88, and the upper end of each spring 98 bears against the lower surface 100 of the associated spaced apart member 26, 28, and the lower end of each compression spring bears against a washer 102 which is in turn fastened to the associated rod 88. The normal position for the various parts is shown in FIG. 7 and it can be seen that each spring 98 will bias the associated rod 88 and cylindrical pin 86 to a lowered position until the washer 102 contacts the bottom of the enlarged upper portion 94 of the elongated aperture within the supporting member 30. To move the pin 86 upwardly to eject the associated lead, it is only necessary to shift the pin 86 and rod 88 upwardly, and to this end the vertically shiftable member 96 is mounted for vertical shifting movement in the direction indicated by the arrow 104. The manner in which the vertically shiftable member is moved upwardly is not material to the present invention, however, it could be by means of a cylinder assembly 106, the vertically shiftable member 96 being secured to the rod 108 of the assembly for movement therewith. The cylinder 110 of the cylinder assembly in such a construction would be mounted in such a manner that it cannot move vertically. By interconnecting hydraulic lines 112 with valve means, a suitable source of fluid under pressure, and a reservoir, the rod 108 can be caused to be moved up and down.

OPERATION

Figure 5:
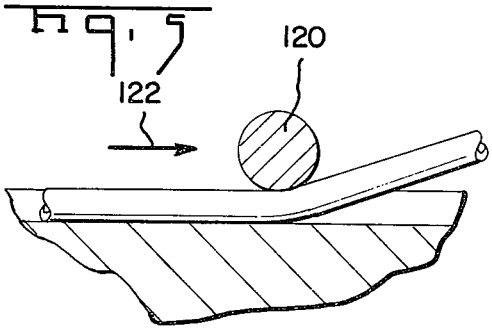
FIG. 5 is a sectional view taken along the lines 5—5 in FIG. 3 showing how the leads are progressively positioned within the grooves.

In operation the sub-assembly 14 is disposed adjacent one end of the template means with one end of the leads 10 and 12 overlying an initial portion of the grooves 22, 24. In this connection it sould be noted that the coil assembly 14 is supported by spaced apart clamp means 116, 118 which are in turn interconnected with a conveyor, the conveyor bringing the coil assembly 14 into a position adjacent the ends of the grooves 22, 24 and then stopping its movement while operations are performed upon the leads. Thus, the leads are held in fixed relationship to each other adjacent one end of the grooves by the sub-assembly 14 and the spaced apart clamp means. Once the leads have been properly positioned with respect to the template means 20, successive parts of the lengths of each of the plurality of leads are progressively positioned into the plurality of grooves. To this end roller means 120, indicated in phantom lines in FIGS. 2 and 3 and shown in cross-section in FIG. 5, are brought to bear upon the upper surface of each of the leads to progressively force successive parts of the leads into the grooves as the roller 120 is moved in the direction indicated by the arrow 122. The matter in which the roller 120 is mounted for movement relative to the template means 20 is not material to the present invention, but it may be mounted in a manner similar to the manner in which the roller is mounted in U.S. application Ser. No.

389,924. It should be appreciated that as the roller moves from the position shown in FIG. 2 to the position shown in FIG. 3 that successive parts of the lengths of the leads are progressively positioned in the grooves. As the principal portions of the grooves have a width and depth greater than the maximum width of any of the leads which are to be associated with the grooves, the leads will not be stretched as they are being progressively positioned in the grooves as might happen if the spacing between the sidewalls of the principal portions were less than the width of the associated leads. However, spaced apart portions of the leads will be retained within the grooves by the spaced apart retaining means 36, and thus, the leads will be properly associated with their associated grooves. In the particular application shown in the drawings accompanying this case, the lead 12 is of greater length than the lead 10, and terminals will be subsequently secured to the cut and stripped ends 16, 18 of the leads 10, 12, respectively. In order to advantageously accomplish this the ends 16 and 18 will be disposed in transverse alignment with each other at the end of the template remote from the coil assembly. Therefore, the groove 24 is bowed to have a greater overall length than the groove 22 between the spaced apart ends of the template means 20. In practice, it has been found desirable to dispose the spaced apart lead retaining means at mid-point at each of the bowed portions to facilitate maintenance of the lead 12 within the groove 24.

After the leads have been positioned in the grooves, each lead will then have a free end portion of a fixed length extending beyond the end 124 of the template means. Terminals 126 may now be applied to the cut and stripped ends 16, 18, and this is done by disposing the terminals on anvil means 128 and then crimping the sidewalls of the terminals 126 about the ends of the leads by moving the anvil means 128 and the crimper means 130 towards each other. When securing the terminals 126 about the ends 16, 18 of the leads either the crimper may be moved down or the anvil may be moved up or both may be moved towards each other. However, since it is necessary that the leads 16 and 18 be placed within the sidewalls of the terminal 126, if the anvil is not moved, then it is necessary to move the template means 120 and its supporting member 30 downwardly. If such movement does take place then the vertical shifting member 96 would also be moved downwardly at the same time to prevent the leads from being ejected from the spaced apart lead retaining means.

After the work operations have been performed upon the ends of the leads adjacent the other end 124 of the grooves by the means 128, 130 the leads are then stripped from the grooves. The stripping in the embodiment shown in the drawings is accomplished merely by advancing the spaced apart clamp means 116, 118 away from the end of the template means in a direction generally transverse to the groove 22 and simultaneously causing the pins 86 to be moved upwardly to free the portions of the leads which are held by the spaced apart lead retaining means.

While a preferred structure in which the principles of the present invention have been incorporated is shown and described above, it is to be understood that the invention is not to be limited to the particular details, shown and described above, but that, in fact, widely differing means may be employed in the practice of the broader aspects of this invention.

I claim:

1. A method for positioning successive lengths of a plurality of electrical leads in fixed spaced apart positions along a template, comprising the steps of:

providing a template with a plurality of spaced apart grooves each having sidewalls defining a width greater then the width of an electrical lead to be received by the groove, providing said template with electrical lead retaining means at selected locations along said grooves, engaging successive lengths of said electrical leads and progressively inserting successive lengths of said leads along corresponding grooves into retention with said lead retaining means without unduly stretching said leads, and thereby positioning ends of said electrical leads at a work station adjacent corresponding ends of said grooves.

2. The structure as recited in claim 1, and further including the step of:

biasing each said electrical leads by said lead retaining means into engagement with one of the sidewalls of a corresponding groove.

3. The structure as recited in claim 1, wherein, said grooves are mutually non-parallel and further including the step of:

displacing a positioning means across said template to engage successive lengths of said electrical leads and to position said successive lengths of said electrical leads along said mutually non-parallel grooves.

4. The structure as recited in claim 1, and further including the steps of:

connecting electrical terminals on the ends of said electrical leads positioned at said work station, and pushing said electrical leads out of engagement with said lead retaining means whereby the electrical leads are readily removed from said template and said work station.

5. In an apparatus for positioning successive lengths of a plurality of electrical leads in fixed spaced apart positions along a template, the improvement comprising:

a template provided with a plurality of spaced apart grooves, each of said grooves being capable of receiving only a single electrical lead, each groove having fixed sidewalls spaced apart from each other a width in excess of the maximum width of a corresponding electrical lead to be received in said groove whereby stretching of electrical leads along said grooves is prevented, lead retaining means on said template associated with each groove for engaging a corresponding electrical lead and retaining a corresponding electrical lead in said groove, positioning means mounted on said apparatus for displacement along said template and for simultaneously positioning a plurality of electrical leads successively along said grooves and into engagement with said lead retaining means, and pushing means mounted on said template and being selectively actuated for pushing said electrical leads out of engagement with said lead retaining means permitting removal of said electrical leads from said template.

6. In an apparatus for positioning successive lengths of a plurality of electrical leads in fixed spaced apart positions along a template, the improvement comprising:

a template provided with a plurality of spaced apart grooves, each of said grooves being capable of receiving only a single electrical lead, each groove having fixed sidewalls spaced apart from each other a width in excess of the maximum width of a corresponding electrical lead to be received in said groove whereby stretching of electrical leads along said grooves is prevented, lead retaining means on said template associated with each groove for engaging a corresponding electrical lead and retaining a corresponding electrical lead in said groove, positioning means mounted on said apparatus for displacement along said template and for simultaneously positioning a pluraity of electrical leads successively along said grooves and into engagement with said lead retaining means, said positioning means being engageable progressively along the lengths of said electrical leads during displacement of said positioning means along said template for progressively inserting successive lengths of said electrical leads along said grooves without stretching said electrical leads, and selectively actuable means for pushing said electrical leads out of engagement with said lead retaining means to permit removal of said electrical leads from said template.

7. The structure as recited in claim 5, wherein, said lead retaining means comprises a shiftable member mounted on said template and being shiftable toward an adjacent sidewall of a corresponding groove for biasing a corresponding electrical lead into engagement with said adjacent groove sidewall whereby said corresponding electrical lead is retained in a corresponding groove.

8. The structure as recited in claim 7, wherein, said pushing means comprises a pin mounted on said apparatus for movement between a corresponding shiftable member and a corresponding adjacent groove sidewall to disengage a corresponding electrical lead from said shiftable member and said adjacent groove sidewall.

9. The structure as recited in claim 6, wherein, said lead retaining means comprises a shiftable member mounted on said template and being shiftable toward an adjacent sidewall of a corresponding groove for biasing a corresponding electrical lead into engagement with said adjacent groove sidewall whereby said corresponding electrical lead is retained in a corresponding groove.

10. The structure as recited in claim 9, wherein, said pushing means comprises a pin mounted on said apparatus for movement between a corresponding shiftable member and a corresponding adjacent groove sidewall to disengage a corresponding electrical lead from said shiftable member and said adjacent groove sidewall.

11. The structure as recited in claim 5, wherein, said lead retaining means comprises:

a pair of retaining sidewalls associated with each corresponding groove and shiftable means for shifting one of said retaining sidewalls toward the other to retain therebetween a corresponding electrical lead.

12. The structure as recited in claim 11, wherein, said pushing means comprises a pin mounted on said apparatus for movement between a corresponding shiftable member and a corresponding adjacent groove sidewall to disengage a corresponding electrical lead from said shiftable member and said adjacent groove sidewall.

13. The structure as recited in claim 11, wherein, said shiftable means comprises a shiftable member provided with said one of said retaining sidewalls, and the other of said retaining sidewalls comprises a portion of a sidewall of a corresponding groove.

14. The structure as recited in claim 13, wherein, said pushing means comprises a pin mounted on said apparatus for movement between each corresponding shiftable member and a corresponding adjacent groove sidewall to disengage a corresponding electrical lead from said shiftable member and said adjacent groove sidewall.

15. The structure as recited in claim 11, wherein, said one of said retaining sidewalls is provided with rounded corners preventing damage to an electrical lead in retention between said retaining sidewalls.

16. The structure as recited in claim 13, wherein, said one of said retaining sidewalls is provided with rounded corners preventing damage to an electrical lead in retention between said retaining sidewalls.

17. The structure as recited in claim 5, and further including:

a work station at an end of each groove receiving each corresponding end portion of electrical leads received in said grooves, and means at said work station for connecting electrical terminals to corresponding electrical lead end portions.

* * * * *